United States Patent [19]

Janello

[11] Patent Number: 4,742,754

[45] Date of Patent: May 10, 1988

[54] COL LEGNO BOW GUARD

[76] Inventor: David Janello, 37 Jamaica St., Apt. 3, Boston, Mass. 02130

[21] Appl. No.: 44,664

[22] Filed: May 1, 1987

[51] Int. Cl.[4] ..... G10D 3/16

[52] U.S. Cl. ..... 84/453; 84/282

[58] Field of Search ..... 84/280 R, 282, 283, 84/453

[56] References Cited

U.S. PATENT DOCUMENTS

| | | | |
|---|---|---|---|
| 1,603,371 | 10/1926 | Zahn | 84/283 |
| 2,782,670 | 2/1957 | Lipski | 84/283 |
| 4,493,238 | 1/1985 | Ricci | 84/282 |

*Primary Examiner*—Lawrence R. Franklin

*Attorney, Agent, or Firm*—Richard L. Miller

[57] ABSTRACT

This device is designed to be received on a bow of a stringed instrument, for impact with the strings of the instrument. Primarily, it consists of a conical and split sleeve or cylinder that is frictionally received on the rod section of the bow of the instrument.

4 Claims, 1 Drawing Sheet

COL LEGNO BOW GUARD

BACKGROUND OF THE INVENTION

The instant invention relates generally to violin bow, and more particularly, to a col legno bow guard.

Numerous bow devices have been provided in the prior art that are adapted to string instruments. For example, U.S. Pat. No. 4,493,238 to Ricci is illustrative of such prior art. While this unit may be suitable for the particular purpose to which it addresses, it would not be suitable for the purpose of the present invention as hereafter described.

SUMMARY OF THE INVENTION

A primary object of the present invention is to provide a col legno bow guard that will overcome the shortcomings of the prior art devices.

Another object is to provide a col legno bow guard, which will be employed on the bow of a string musical instrument.

An additional object is to provide a col legno bow guard, which will be designed so as to be employed on a conical bow, and it will be fabricated of wood or plastic and will be light in weight.

The present invention will be employed with the violin, violincello and contrabass bows, for preventing damage cause by "col legno performance", which is percussive striking of the wooden rod section of the bow against the instrument string. Most string instrument sounds are created by drawing the hairs of the bow over the strings of the instruments. In the performance of certain musical scores, however, it is necessary to strike the violin or other stringed instrument's strings with the wooden rod section of the bow to produce the desired effect. The impact of the rod section against the instrument strings, causes substantial damage to the wood and varnish of the bow. Heretofore, performers had no means of preventing such damage, since prior art bows have no means of shielding the rod section from impact against the instrument's strings. Therefore, the present invention will be of such design, as to protect performers instruments and the investment therein, by preventing the strings from cutting the bow, and the invention will also prevent the varnish from the back of the bow getting into the strings.

A further object is to provide a col legno bow guard that is simple and easy to use.

A still further object is to provide a col legno bow guard that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
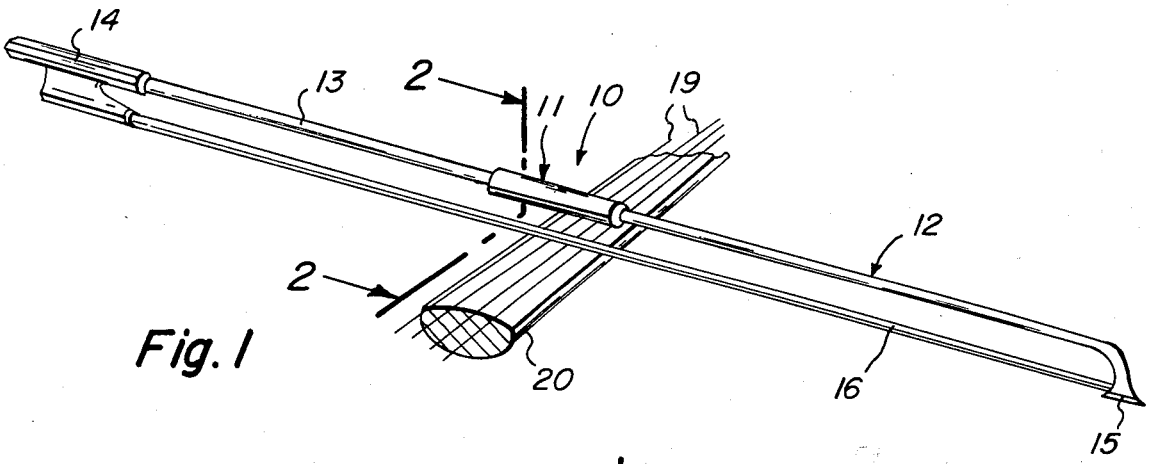
FIG. 1 is a perspective view of the invention, showing a violin fragmentary.
Figure 2:
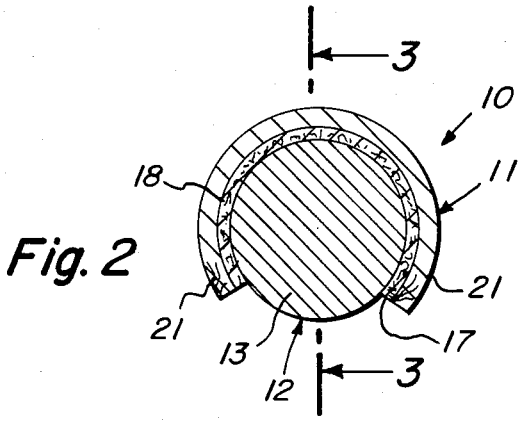
FIG. 2 is a cross-sectional view on line 2—2 in FIG. 1, of just a portion of the tapered bow and the instant invention per se.
Figure 3:
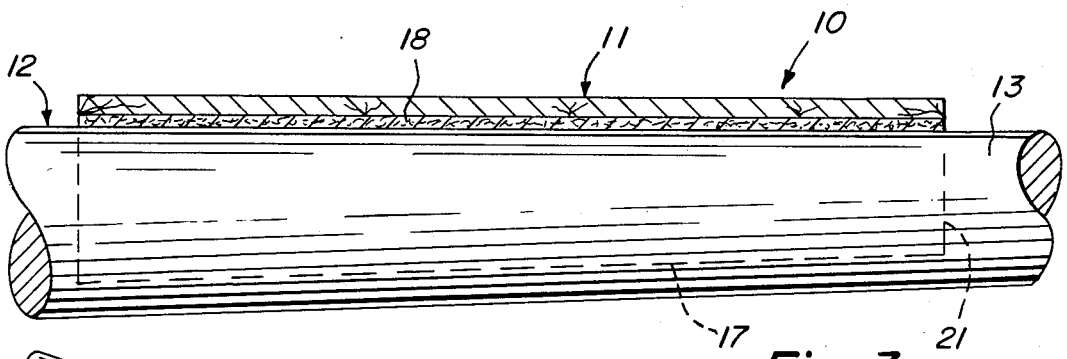
FIG. 3 is a fragmentary partial view of a tapered bow with the invention shown in cross-section along the line 3—3 of FIG. 2.
Figure 4:
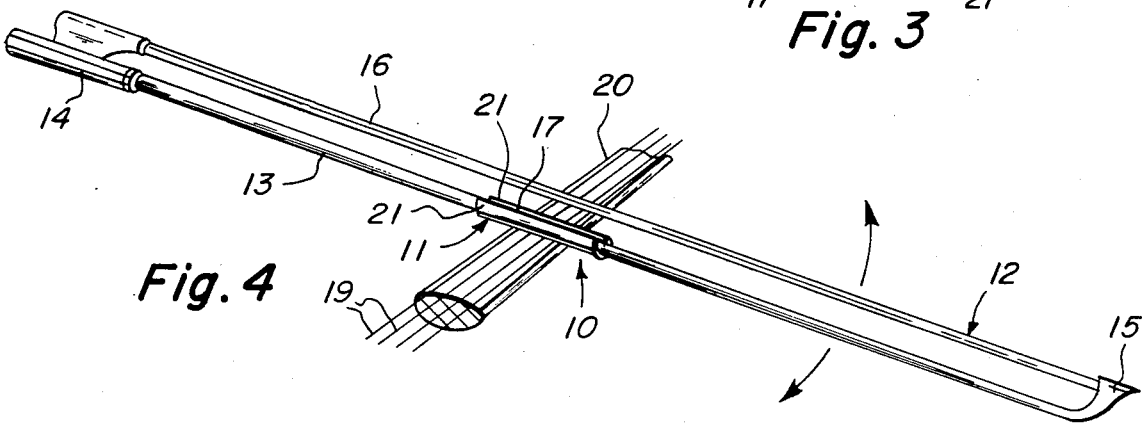
FIG. 4 is similar to FIG. 1, but illustrates the invention striking the strings.

Turning now descriptively to the drawings, in which like reference characters denote like elements throughout the several views, FIG. 1 illustrates a bow guard 10, that includes a conical cylindrical main body 11, fabricated preferably of wood, so as to not to substantially alter the normal weight of instrument bow 12, which is provided with an elongated and tapered rod section 13 having a frog 14 at one end for being grasped by a musician, and a tip 15 at the opposite end. Hair 16 is mounted on and extends between frog 14 and tip 15, in a conventional manner, and a longitudinal cut-out 17 is provided in main body 11 enabling 11 to be reclined on the outer peripheral surface of rod section 13, which hereinafter will be described.

A felt or other suitable lining 18 is suitably adhered to the inner peripheral surface of main body 11, for protective gripping of rod section 13 of bow 12, when guard 10 is frictionally received on section 13 for striking strings 19.

In installation, the guard 10 is aligned with its larger end aligned with the larger portion of the rod section 13. After the above, the cut-out opening 17 is placed on the smaller diameter end of the rod section with the opening 17 in the downward position. After this is accomplished, the guard 10 is urged towards the larger diameter portion of rod section 13, until the leg portions 21 of main body 11 frictionally engage rod section 13 to a desired position for impact use upon the strings 19, and shall be noted, that the frictional gripping of guard 10 is sufficient to preclude shifting its position on rod section 13 during use.

It shall further be recognized, that guard 10 is also of sufficient length to cover the bow strings 19 of the instrument 20.

In use, the bow 12 is inverted for the percussive engagement with instrument 20, and as a result, all percussive impacts between the instrument strings 19 and the guard 10, occur upon the main body 11, rather than upon the rod section 13 of bow 12.

While certain novel features of this invention have been shown and described and are pointed out in the annexed claims, it will be understood that various omissions, substitutions and changes in the forms and details of the device illustrated and in its operation can be made be those skilled in the art without departing from the spirit of the invention.

What is claimed is:

1. A guard for a tapered bow to protect the bow and a set of strings on a tringed musical instrument during col legno playing, said guard comprising:

a sleeve having a hollow, conical interior and a logitudinal slit extending the length of said sleve, said conical interior being of such a diameter and taper to frictionally grip the bow for which it is adapted in the region of impact of the bow on the strings during col legno playing, said sleeve having a length sufficient to extend across the transverse dimension of said set of strings, and a lining secured to the interior of said sleeve.

2. A guard as in claim 1 wherein the material of said guard is such that an acceptable sound is produced during said col legno playing.

3. A guard as in claim 1 wherein said lining is soft and is adhered to said guard.

4. A guard as in claim 3 wherein said lining is felt.

* * * * *